US005702269A

United States Patent [19]

Uchida et al.

[11] Patent Number: 5,702,269

[45] Date of Patent: Dec. 30, 1997

[54] ELECTRICAL CONNECTOR

[76] Inventors: Masaki Uchida, 2-52-9-306, Higashi-Tokorozawa, Tokorozawa, Saitama, Japan, 359; Takaki Naito, 6-11-6-802, Koyodai, Inagi, Tokyo, Japan, 206; Hiroshi Shirai, 3-32-15-205, Higashitokorozawa, Tokorozawa, Tokyo, Japan, 359; Koichi Iino, 1119-111, Ida, Nakahara-ku, Kawasaki, Kanagawa, Japan, 211; Hiroyuki Okazaki, 6-8-15, Yokodai, Sagamihara, Kanagawa, Japan, 229

[21] Appl. No.: 738,138

[22] Filed: Oct. 25, 1996

[30] Foreign Application Priority Data

Oct. 31, 1995 [JP] Japan ..... 7-306564

[51] Int. Cl.[6] ..... H01R 13/04

[52] U.S. Cl. ..... 439/496; 439/67

[58] Field of Search ..... 439/496, 67, 493, 439/495, 77, 66, 91, 630, 637, 492

[56] References Cited

U.S. PATENT DOCUMENTS 4,373,764 2/1983 Ulrich ..... 439/260

4,784,615 11/1988 Teng-Hong ..... 439/496

5,156,553 10/1992 Katsumata et al. ..... 439/493

5,297,968 3/1994 Johnson et al. ..... 439/91

5,378,161 1/1995 Loder ..... 439/496

*Primary Examiner*—Gary F. Paumen

*Assistant Examiner*—Tho D. Ta

[57] ABSTRACT

An electrical connector for interconnecting a flexible printed circuit with a printed circuit board comprises a plug connector and a socket connector. The plug connector includes a plug housing having an end portion of the flexible printed circuit fastened thereon. The socket connector includes a socket housing which defines a cavity open through a top of the socket housing and dimensioned to receive the plug connector therein. A flexible film which carries a plurality of conductors is wrapped around an elastomer, and the elastomer is disposed in the cavity with the conductors arrayed for mating engagement with respective circuit paths on the flexible printed circuit. The flexible film is fastened to a bridge part of the socket housing adjacent to the cavity.

3 Claims, 11 Drawing Sheets

ELECTRICAL CONNECTOR

FIELD OF THE INVENTION

The invention relates to an electrical connector for mating a flexible printed circuit with a printed circuit board.

BACKGROUND OF THE INVENTION

Connectors known as flexible printed circuit (FPC) connectors (of the type shown in FIG. 21, for example) have been used in the past for electrically connecting flexible printed circuits to printed circuit boards (Japanese Utility Model Application Kokai No. 1-9376). Such an FPC connector 500 has metal contacts 504 possessing elasticity which are housed in an insulating housing 502. In this case, electrical continuity between a flexible printed circuit 506 and a printed circuit board 508 can be obtained by inserting the connecting end of the flexible printed circuit 506 into the FPC connector 500 so that the connecting end engages the metal contacts 504.

A preselected material thickness and spring length are required in order to obtain the necessary spring characteristics, or elasticity, of the metal contacts. Due to manufacturing tolerances on dimensions of the housing and positions of the contacts in the housing, it is extremely difficult to reduce the size and weight of the connector by narrowing the pitch, lowering the height or reducing the size of the contacts.

SUMMARY OF THE INVENTION

It is an object of the invention is to provide an FPC connector which has a reduction in size and weight.

In one embodiment, an electrical connector for interconnecting a flexible printed circuit with a printed circuit board comprises:

a plug connector including a plug housing having an end portion of the flexible printed circuit fastened thereon; and a socket connector including a socket housing which defines a cavity open through a top of the socket housing and dimensioned to receive the plug connector therein, a flexible film which carries a plurality of conductors and is wrapped around an elastomer, the elastomer being disposed in the cavity with the conductors being arrayed for mating engagement with respective circuit paths on the flexible printed circuit, and the flexible film being fastened to a bridge part of the socket housing adjacent to the cavity.

In another embodiment the electrical connector further comprises a pair of said elastomers which are disposed in the cavity on opposite sides thereof. In such an embodiment the flexible printed circuit of the plug connector may have independent circuit paths on respective opposite sides of the plug housing, with the plug housing receivable in the cavity between the pair of elastomers.

BRIEF DESCRIPTION OF THE DRAWINGS

The invention will now be described by way of example with reference to he accompanying drawings wherein.

DETAILED DESCRIPTION OF THE PREFERRED EMBODIMENT

Figure 1:
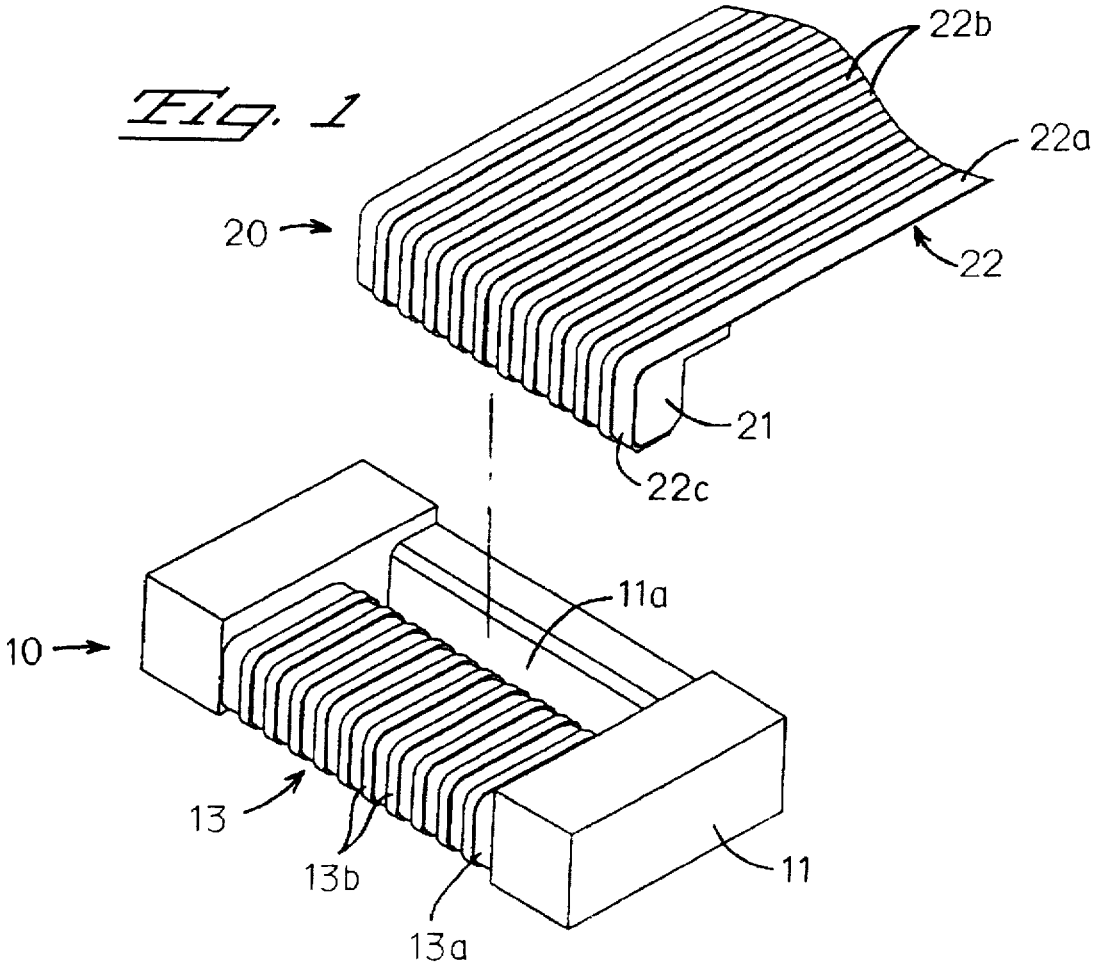
FIG. 1 is perspective view of plug and socket connectors for an electrical connector of the present invention.
Figure 2:
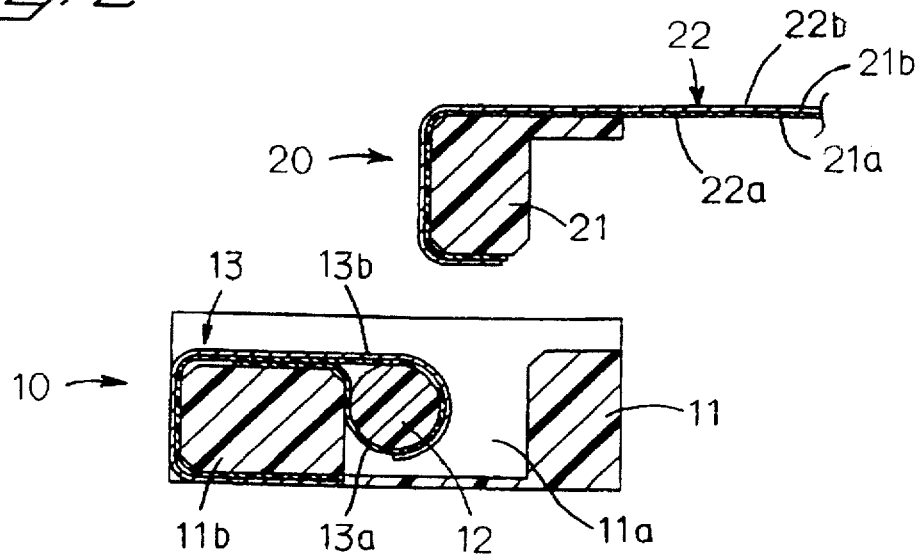
FIG. 2 is a cross-sectional view of the connector shown in FIG. 1.

There is shown in FIGS. 1 and 2 a flexible printed circuit (FPC) connector according to one embodiment of the invention. The FPC connector includes a socket connector 10 and a plug connector 20. The socket connector 10 includes a flexible film 13 which is wrapped around the circumference of a columnar elastomer 12, and a socket housing 11 which has a cavity 11*a* formed roughly in the center of the housing. As shown in the drawings, the cavity 11*a* is enclosed by a bottom wall of the housing; however, the cavity 11*a* could extend entirely through the socket housing 11. The flexible film 13 includes a base film 13*a* and a plurality of parallel conductor patterns 13*b* which are formed on surface 13*a* of the flexible film 13. The columnar elastomer 12 is installed inside the cavity 11*a* of the socket housing 11. The flexible film 13 is wrapped around a bridge part 11*b* which is located adjacent to the cavity 11*a*, and all or part of the flexible film 13 contacting the bridge part 11*b* is fastened to the socket housing 11 by adhesive bonding, heat-and-pressure bonding, thermal caulking or the like. Because of the need for flexibility of the flexible film and suitability of this film for the application of photolithographic techniques, it is desirable that the material of the base film 13 be a polyimide. The material of the elastomer 12 may be a natural rubber, polybutadiene rubber, chloroprene rubber, styrene-butadiene copolymer rubber, ethylene-propylene copolymer rubber, thermoplastic elastomer, silicone rubber, vinylmethylsilicone rubber, fluorinated silicone rubber, fluorine-containing rubber or the like. However, from the standpoint of heat resistance during soldering, a silicone rubber, vinylmethylsilicone rubber, fluorinated silicone rubber, fluorine-containing rubber or the like is desirable.

The plug connector 20 includes a plug housing 21 and a flexible printed circuit 22. The flexible printed circuit 22 has circuit paths **22*b* arrayed on a flexible film 22*a*. An end portion 22*c* of the flexible printed circuit is fastened to an outer surface of the plug housing 21** in a prescribed position by means of a technique such as adhesive bonding, heat-and-pressure bonding, thermal caulking or the like.

The socket connector 10 may be soldered to the surface of a printed circuit board (not shown in the Figures) by means of a surface mounting technique. In this case, the conductor patterns **13*b* of the socket connector 10** act as contact leads; accordingly, these conductor patterns are soldered to conductive pads (not shown in the Figures) on the surface of the printed circuit board.

Figure 3:
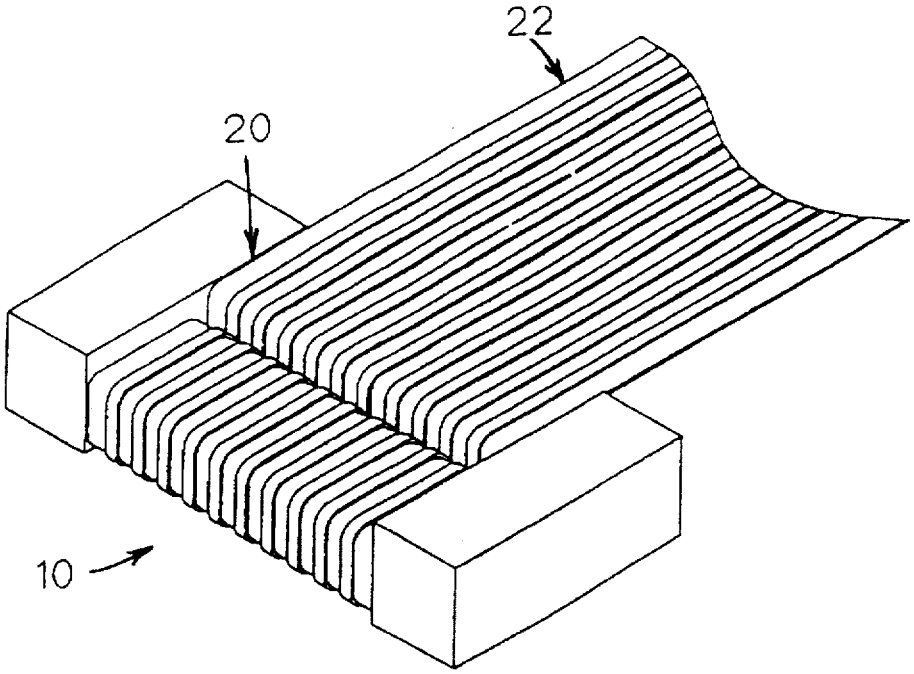
FIG. 3 is a perspective view showing the connector in a mated condition.
Figure 4:
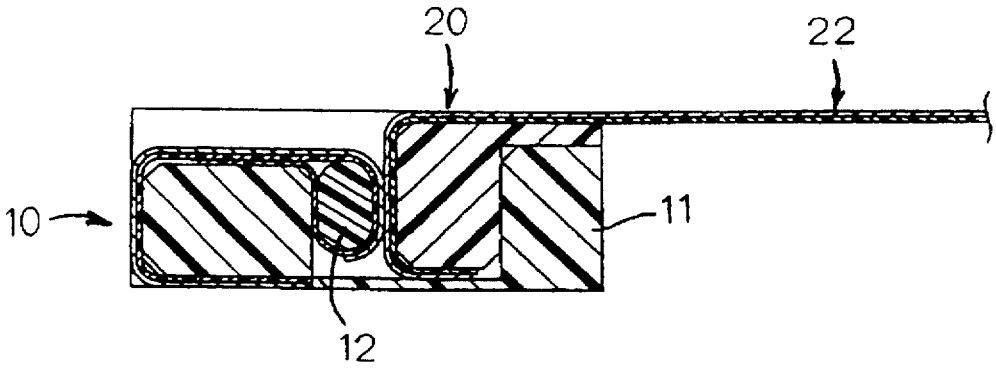
FIG. 4 is a cross-sectional view of the connector shown in FIG. 3.

The plug and socket connectors are joined by inserting the plug connector 20 into the cavity **11*a* of the socket connector 10 as shown in FIGS. 3 and 4, thereby causing elastic deformation of the elastomer 12** which generates a contact pressure required for connection. As a result, the conductor patterns of both connectors contact each other so that mutual electrical connection is achieved.

Figure 5:
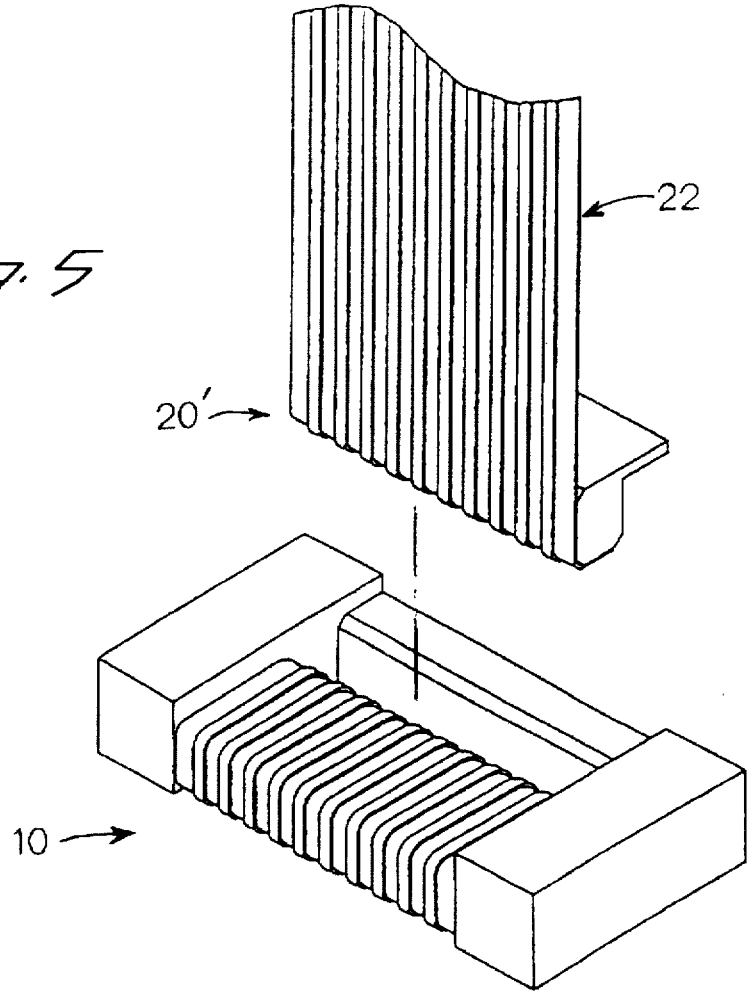
FIG. 5 is a perspective view of the connector which is adapted for perpendicular mating.
Figure 6:
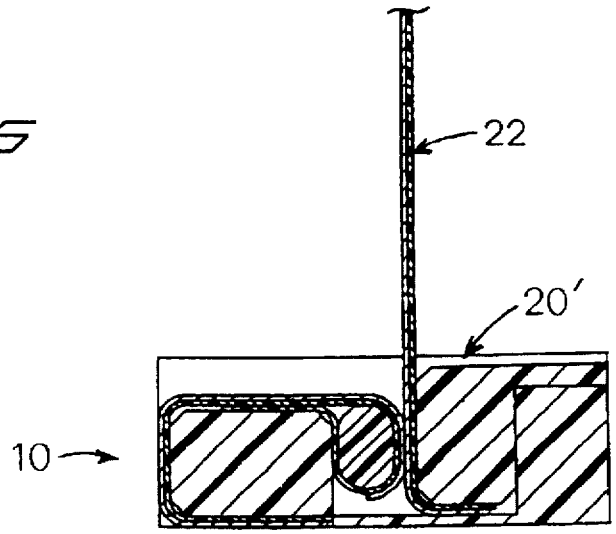
FIG. 6 is a cross-sectional view of the connector shown in FIG. 5.
Figure 7:
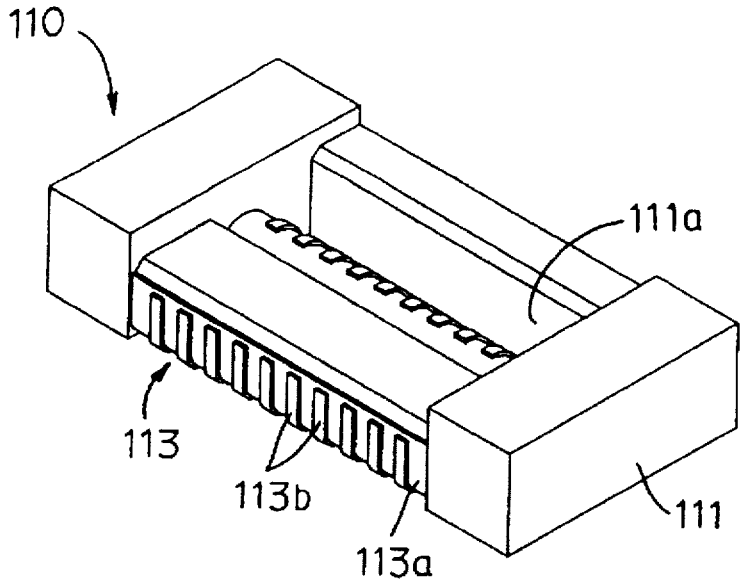
FIG. 7 is a perspective view of a socket connector in an alternate embodiment.
Figure 8:
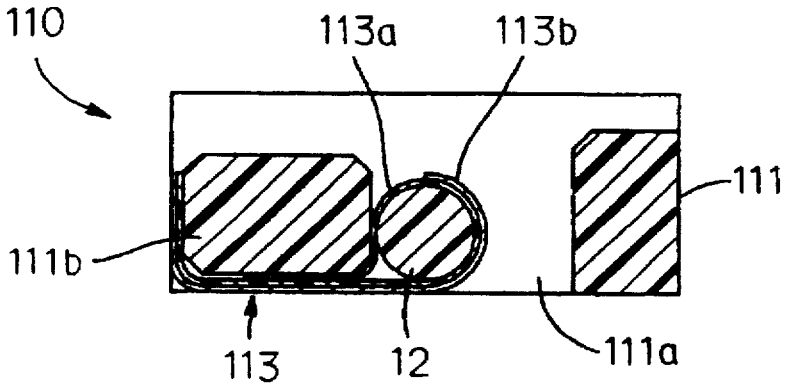
FIG. 8 is a cross-sectional view of the socket connector shown in FIG. 7.

As shown in FIGS. 5 and 6, a plug connector 20' may be configured to enable the flexible printed circuit 22 to extend in a perpendicular orientation with respect to the printed circuit board on which the socket connector 10 is mounted. In either case, the flexible film 13 which envelops the elastomer 12 is fastened to the upper surface of the bridge part **11*b* of the socket housing 11 in the socket connector 10, as shown in FIGS. 1 and 2. Accordingly, there is no peeling of the flexible film 13 from the bridge part 11 when the plug connector 20 is inserted, and insertion of the plug connector 20** is facilitated.

FIGS. 7 through 10 illustrate alternate embodiments of the socket connector. Socket connectors 110 and 210 differ from the socket connector 10 in the manner of attachment of the flexible film to the socket housing. In the socket connector 110 shown in FIGS. 7 and 8, flexible film 113 is fastened to three surfaces (i.e., all of the surfaces except for the top surface) of bridge part **111*b* of the socket housing 111. Accordingly, when the socket connector 110 is joined with the plug connector 20 of FIG. 1, the electrical path between the flexible printed circuit 22 (FIG. 1) and the printed circuit board (not shown) is short. Furthermore, conductor patterns 113*b* which are exposed on the outer surface are short, thereby reducing the likelihood of short-circuiting between the conductor patterns 113*b*** due to foreign matter.

Figure 9:
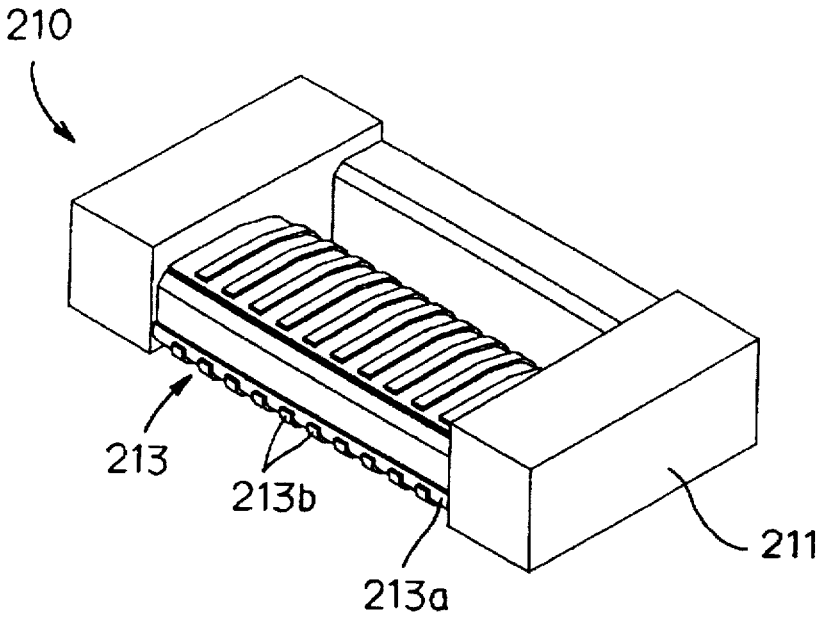
FIG. 9 is a perspective view of the socket connector in another embodiment.
Figure 10:
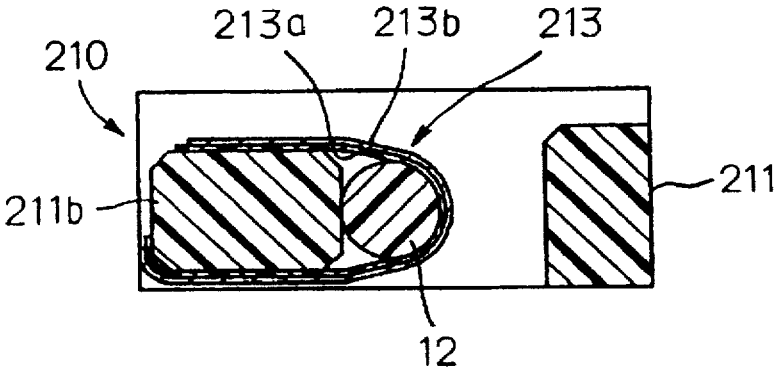
FIG. 10 is a cross-sectional view of the socket connector shown in FIG. 9.
Figure 11:
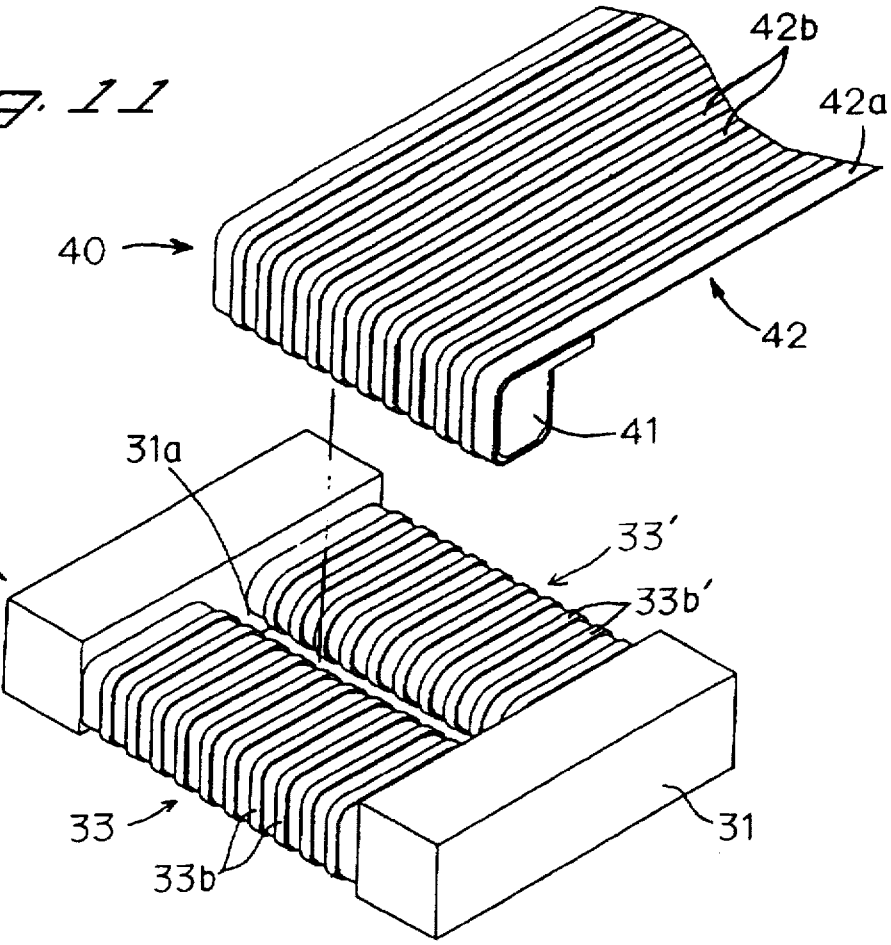
FIG. 11 is perspective view of the electrical connector in yet another embodiment.
Figure 12:
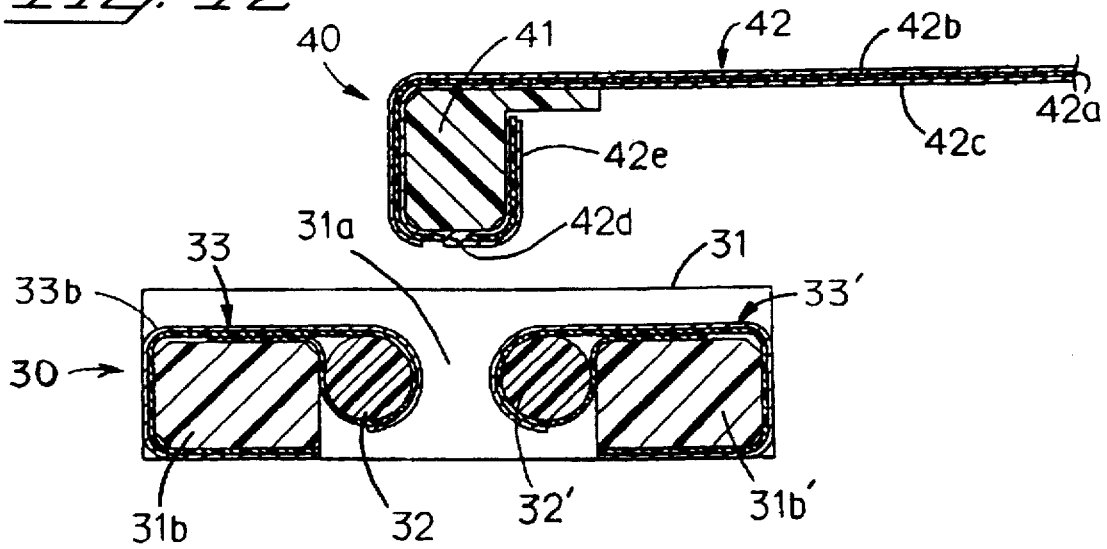
FIG. 12 is a cross-sectional view of the connector shown in FIG. 11.

In the socket connector 210 shown in FIGS. 9 and 10, flexible film 213 covers approximately half of the circumference of the elastomer 12. Furthermore, one end of the flexible film 213 is fastened to the upper surface of the bridge part **211*b* of the socket housing 211, while the other end of the flexible film 213 is fastened to the undersurface and a portion of the outside surface of the bridge part 211*b*. As a result, there is no peeling of the flexible film 213 from the bridge part 211*b* when the plug socket 20 of FIG. 1 is inserted or removed. Accordingly, insertion and removal of the plug connector 20 are facilitated, and the electrical path between the flexible printed circuit 22 (FIG. 1) and the printed circuit board beneath the socket connector 210** is short.

With reference to FIGS. 11 through 16, another embodiment of the FPC connector includes a socket connector 30 and a plug connector 40. The socket connector 30 includes flexible films 33, 33' which are wrapped around the circumferences of columnar elastomers 32, 32', and a socket housing 31 which has a cavity **31*a* located in the center of the housing. This embodiment differs from the earlier described embodiment in that flexible films 33, 33' are wrapped around the respective circumferences of two bridge parts 31*b*, 31*b'* of the socket housing 31, and in that two columnar elastomers 32, 32' are installed inside the cavity 31*a*, with a gap being left between the respective elastomers 32, 32'**.

The plug connector 40 has conductor patterns **42*b*, 42*c* formed on both surfaces of base film 42*a* of a flexible printed circuit 42. Further, inside conductor patterns 42*c* are electrically connected with outside conductor patterns 42*e* via through-holes 42*d* in the connecting part located on the end portion of the flexible printed circuit 42. The flexible printed circuit 42 is fastened to the outer surface of a plug housing 41** in a specified position by means of a technique such as adhesive bonding, heat-and-pressure bonding, thermal caulking or the like.

Figure 13:
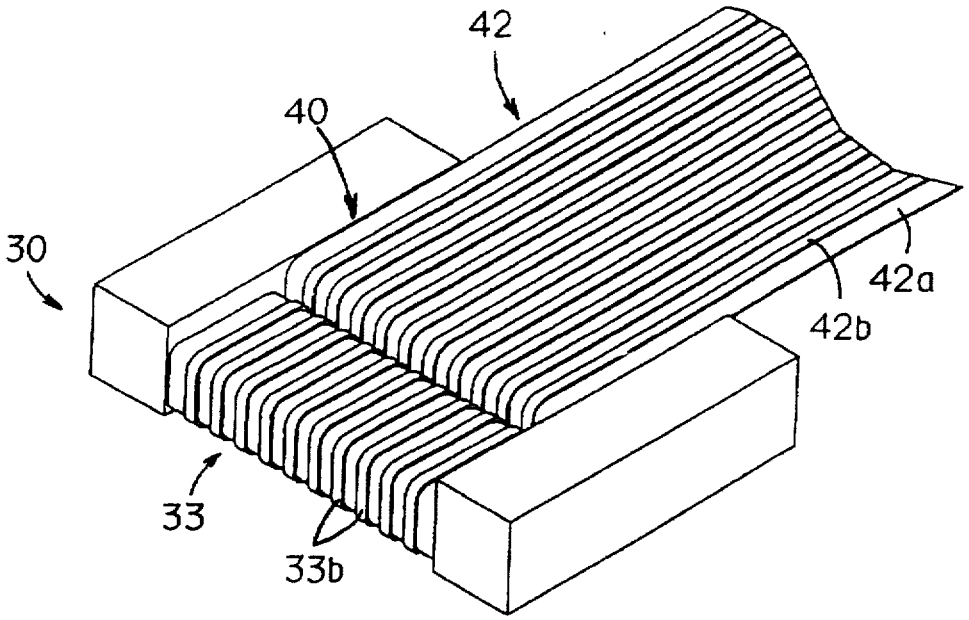
FIG. 13 is a perspective view of the connector shown in FIG. 11 in a mated condition.
Figure 14:
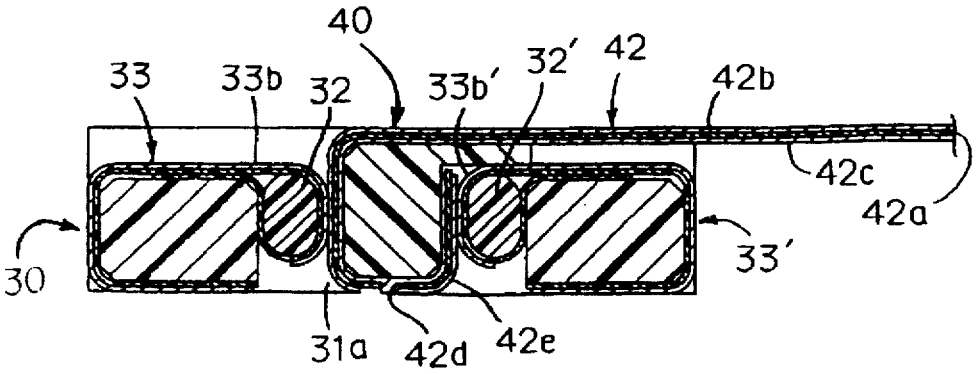
FIG. 14 is a cross-sectional view of the mated connector shown in FIG. 13.

As shown in FIGS. 13 and 14, when the plug connector 40 is inserted into the socket connector 30, the conductor patterns **42*b* on the upper side of the flexible printed circuit 42 make elastic contact with the conductor patterns 33*b* on the flexible film 33 located on the left side of the socket connector 30, and conductor patterns 42*e* which are connected with the conductor patterns 42*c* on the lower side of the flexible printed circuit 42 make elastic contact with the conductor patterns 33*b'* on the flexible film 33' located on the right side of the socket connector 30**.

Figure 15:
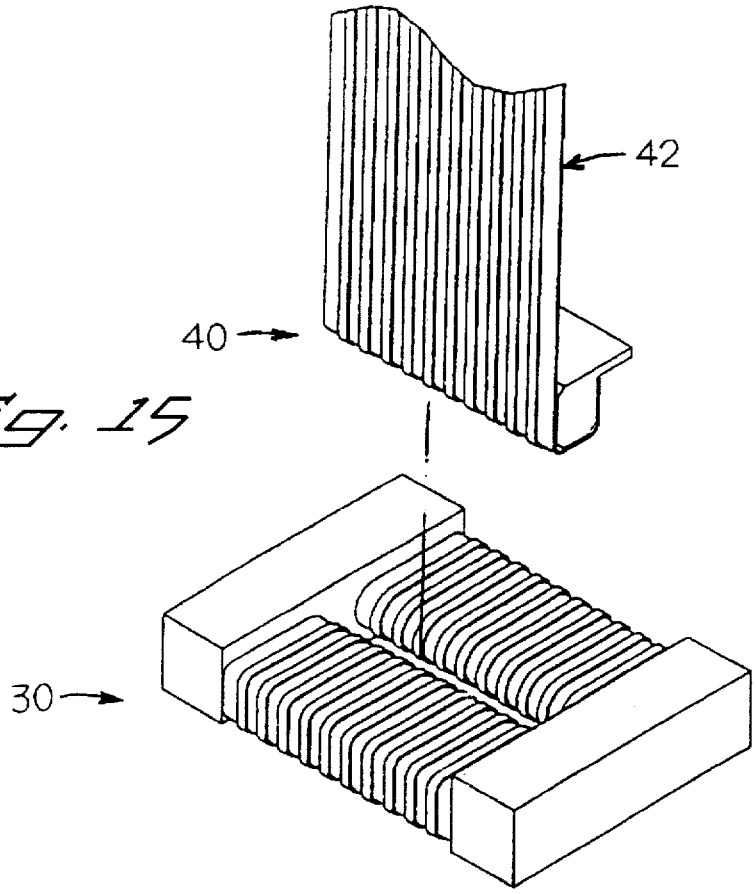
FIG. 15 is a perspective view of the connector shown in FIG. 11 which has been adapted for perpendicular mating.
Figure 16:
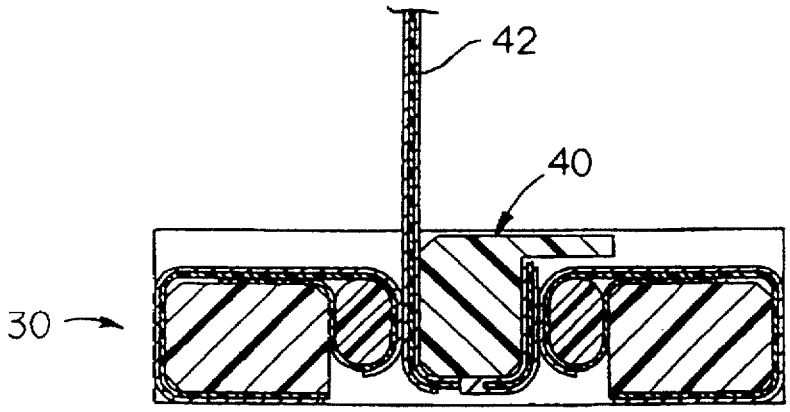
FIG. 16 is a cross-sectional view illustrating a connected state of the connector shown in FIG. 15.
Figure 17:
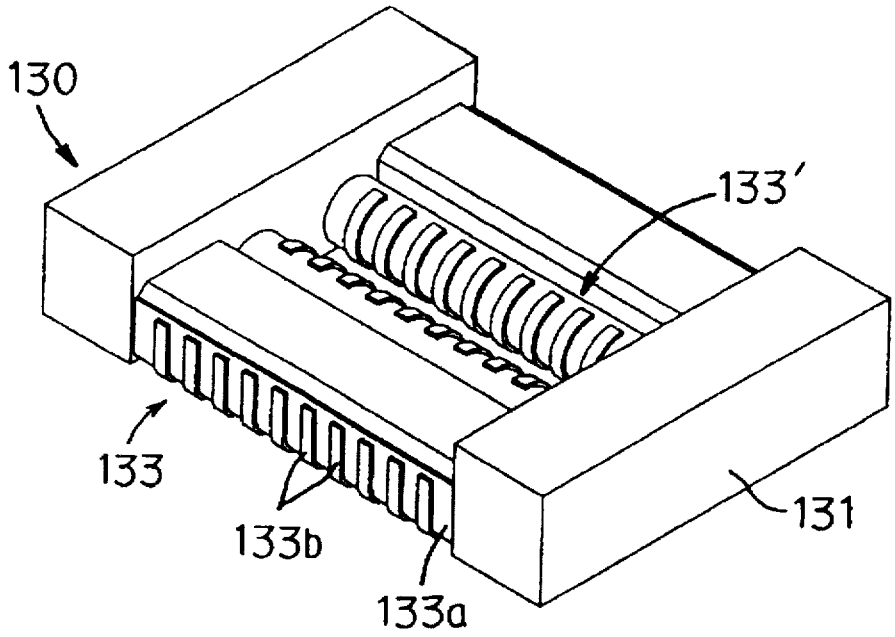
FIG. 17 is a perspective view of the socket connector in yet another embodiment.
Figure 18:
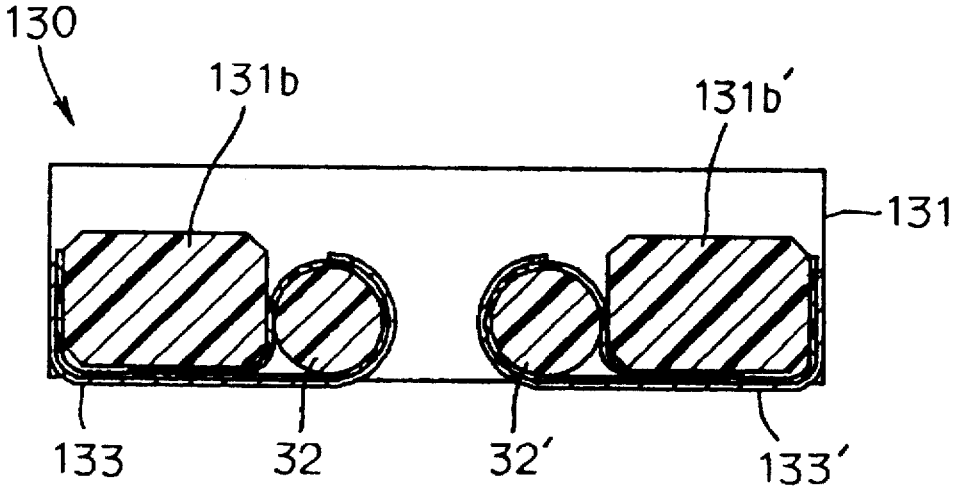
FIG. 18 is a cross-sectional view of the connector shown in FIG. 17.

As shown in FIGS. 15 and 16, the plug connector 40 may be configured so that the flexible printed circuit 42 can extend in a perpendicular orientation with respect to the printed circuit board.

FIGS. 17 through 20 illustrate another embodiment of the socket connector. Socket connectors 130 and 230 differ from the socket connector 30 in the manner of attachment of the flexible films to the socket housing. Specifically, in the socket connector 130 shown in FIGS. 17 and 18, the respective flexible films 133 and 133' are each fastened to three surfaces (i.e., all of the surfaces except for the top surface) of respective bridge parts **131*b* and 131*b'* of the socket housing 131**.

Figure 19:
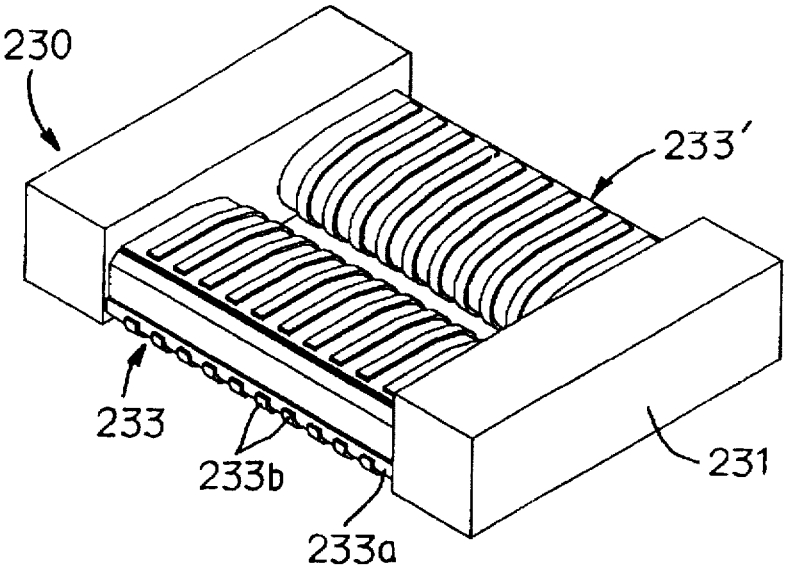
FIG. 19 is a perspective view of the socket connector in yet another embodiment.
Figure 20:
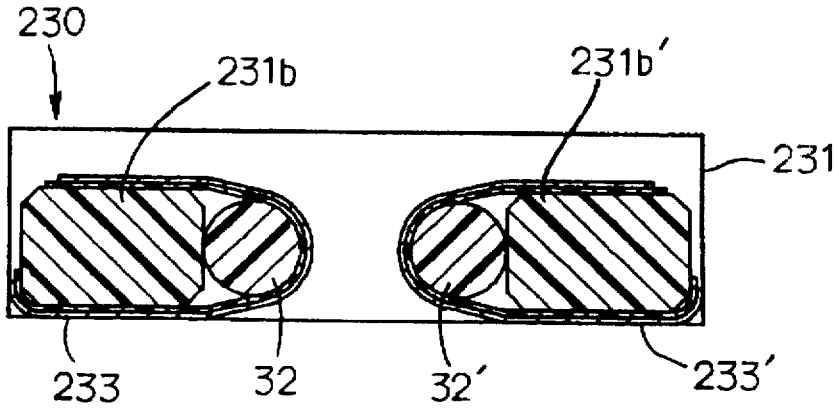
FIG. 20 is a cross-sectional view of the connector shown in FIG. 19.
Figure 21:
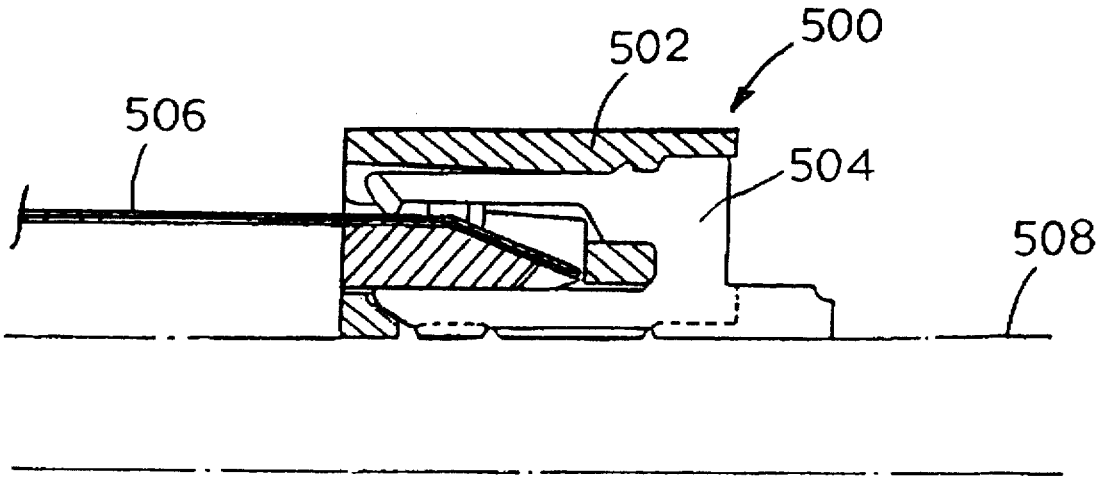
Fig. 21 ( PRIOR ART )
FIG. 21 is a cross-sectional view of a prior art electrical connector.

In the socket connector 230 shown in FIGS. 19 and 20, the respective flexible films 233 and 233' each cover approximately half of the circumference of the corresponding elastomers 32 and 32'. Further, one end of each of the flexible films 233 and 233' is fastened to the upper surface of one of the corresponding bridge parts **231*b* and 231*b'* of the socket housing 231, while the other end of each flexible film 233 and 233' is fastened to the undersurface and a portion of the outside surface of the corresponding bridge parts 231*b* and 231*b'*. Fastening the flexible films in this manner achieves the same benefits as in the socket connectors shown in FIGS. 7 through 10**, namely, a shortened electrical path and reduced likelihood of short circuiting.

As was described above, the FPC connector of the present invention uses conductor patterns **13*b*, 33*b*, 113*b*, 133*b*, 213*b*, 233*b* formed on flexible films 13, 33, 113, 133, 213, 233 as conductors. These flexible films 13, 33, 113, 133, 213, 233** are formed by photolithographic techniques; accordingly, a narrow pitch can be obtained.

An electrical connector according to the invention provides a number of advantages. Since the connector has contacts made from flexible films which can be manufactured by photolithographic techniques, the connector is capable of handling a narrow pitch, and the positional precision of the respective conductor patterns can be maintained at a high level.

Furthermore, since elasticity of the contacts is maintained by means of an elastomer such as a silicone rubber or the like, advantages such as lower height, reduced cost, reduced weight and easy connector assembly can be obtained compared to FPC connectors using metal contacts.

Furthermore, by forming a connecting portion on the end of the flexible printed circuit into a plug connector, mating with the socket connector can occur from above, i.e., in a direction oriented perpendicular to the printed circuit board, even in cases where the flexible printed circuit extends parallel to the printed circuit board. Accordingly, connection can be accomplished very easily.

We claim:

1. An electrical connector for interconnecting a flexible printed circuit with a printed circuit board, the electrical connector comprising:

a plug connector including a plug housing having an end portion of the flexible printed circuit fastened thereon; and a socket connector including a socket housing which defines a cavity open through a top of the socket housing and dimensioned to receive the plug connector therein, a flexible film which carries a plurality of conductors and is wrapped around so as to be in direct contact with a substantial portion of an elastomer, the elastomer being disposed in the cavity with the conductors being arrayed for mating engagement with respective circuit paths on the flexible printed circuit, and the flexible film being fastened to a bridge part of the socket housing adjacent to the cavity.

2. The electrical connector according to claim 1, wherein a pair of said elastomers are disposed in the cavity on opposite sides thereof.

3. The electrical connector according to claim 2, wherein the flexible printed circuit of the plug connector has independent circuit paths on respective opposite sides of the plug housing, and the plug housing is receivable in the cavity between the pair of elastomers.

* * * * *